US010940363B2

(12) United States Patent
Valdez et al.

(10) Patent No.: US 10,940,363 B2
(45) Date of Patent: Mar. 9, 2021

(54) SHOULDER REHABILITATION DEVICE

(71) Applicant: BOARD OF REGENTS OF THE UNIVERSITY OF TEXAS SYSTEM, Austin, TX (US)

(72) Inventors: Abraham Valdez, San Antonio, TX (US); Joshu Raiten, Naples, FL (US)

(73) Assignee: BOARD OF REGENTS OF THE UNIVERSITY OF TEXAS SYSTEM, Austin, TX (US)

( * ) Notice: Subject to any disclaimer, the term of this patent is extended or adjusted under 35 U.S.C. 154(b) by 21 days.

(21) Appl. No.: 15/558,520

(22) PCT Filed: Mar. 14, 2016

(86) PCT No.: PCT/US2016/022330

§ 371 (c)(1),
(2) Date: Sep. 14, 2017

(87) PCT Pub. No.: WO2016/149195

PCT Pub. Date: Sep. 22, 2016

(65) Prior Publication Data

US 2018/0078817 A1 Mar. 22, 2018

Related U.S. Application Data

(60) Provisional application No. 62/133,303, filed on Mar. 14, 2015.

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 71/00*** | (2006.01) |
| ***A63B 22/00*** | (2006.01) |

(Continued)

(52) U.S. Cl.

CPC ..... *A63B 23/1245* (2013.01); *A63B 21/0058* (2013.01); *A63B 21/00072* (2013.01); *A63B 21/00181* (2013.01); *A63B 21/068* (2013.01); *A63B 21/4035* (2015.10); *A63B 21/4045* (2015.10); *A63B 21/00061* (2013.01); *A63B 21/00178* (2013.01); *A63B 21/0628* (2015.10); *A63B 23/1263* (2013.01); *A63B 2022/0094* (2013.01); *A63B 2071/0018* (2013.01); *A63B 2225/09* (2013.01); *A63B 2225/093* (2013.01)

(58) Field of Classification Search

CPC ..... A63B 21/00181; A63B 21/068; A63B 21/4045; A63B 21/0058; A63B 21/00072; A63B 21/4035; A63B 21/0628; A63B 21/00061; A63B 21/00178; A63B 2022/0094; A63B 2071/0018; A63B 2225/09; A63B 23/1263; A63B 2225/093; A63B 23/129; A63B 23/1245–1272

See application file for complete search history.

(56) References Cited

U.S. PATENT DOCUMENTS 2,282,881 A * 5/1942 Ostrow ..... A63H 33/006 446/227
2,719,038 A * 9/1955 Massa ..... A63B 5/02 482/82

(Continued)

*Primary Examiner* — Andrew S Lo
(74) *Attorney, Agent, or Firm* — Smith, Gambrell & Russell LLP

(57) ABSTRACT

Embodiments described herein are directed to a device and method of using the device for shoulder rehabilitation.

20 Claims, 9 Drawing Sheets

(51) Int. Cl.
*A63B 21/005* (2006.01)
*A63B 21/062* (2006.01)

(56) References Cited

U.S. PATENT DOCUMENTS 3,465,592 A * 9/1969 Perrine ..... A61B 5/224 482/5
3,581,408 A * 6/1971 Mohier ..... A63F 9/0876 434/258
3,952,424 A * 4/1976 Herr ..... G09B 11/00 434/162
D324,698 S * 3/1992 Bruns ..... D19/25
5,133,684 A * 7/1992 Rhodes ..... A63H 33/00 248/153
6,203,398 B1 * 3/2001 Lin ..... A63H 33/00 446/489
6,702,643 B1 * 3/2004 Drosendahl ..... A63H 33/006 446/175
7,074,133 B1 * 7/2006 Jones ..... A63B 69/3641 473/226
8,021,240 B2 * 9/2011 King ..... A63B 9/00 446/85
9,596,830 B2 * 3/2017 Yannello ..... A01K 15/025
9,604,094 B2 * 3/2017 Kosyan ..... A63B 21/0455
2002/0094913 A1 * 7/2002 Valentino ..... A61H 1/0285 482/45
2003/0028130 A1 * 2/2003 Wunderly ..... A61H 1/0274 601/5
2004/0242381 A1 * 12/2004 Parmater ..... A63B 22/205 482/71
2004/0266312 A1 * 12/2004 Oren ..... A45D 42/16 446/227
2006/0116249 A1 * 6/2006 Dibble ..... A63B 21/045 482/72
2008/0070712 A1 * 3/2008 Jones ..... A63B 69/3641 473/257
2009/0111351 A1 * 4/2009 Krochak ..... A63F 9/34 446/137
2010/0099542 A1 * 4/2010 Fernandez ..... A63B 22/001 482/142
2010/0234776 A1 * 9/2010 Borden ..... A61H 1/0281 601/33
2011/0300994 A1 * 12/2011 Verkaaik ..... A61H 1/0274 482/51
2012/0035512 A1 * 2/2012 Su ..... A61H 1/0281 601/5
2013/0190662 A1 * 7/2013 Stevenot ..... A61H 1/0281 601/33
2013/0217551 A1 * 8/2013 Parnell ..... A63B 21/0442 482/141
2013/0245510 A1 * 9/2013 Zaborowski ..... A61H 1/0237 601/33
2013/0284182 A1 * 10/2013 Valdez ..... A61H 1/0281 128/845
2014/0141949 A1 * 5/2014 Mills ..... A63B 23/1236 482/140
2014/0194266 A1 * 7/2014 Raiten ..... A63B 23/0482 482/142
2016/0317858 A1 * 11/2016 Lagree ..... A63B 23/0233
2016/0317863 A1 * 11/2016 Goldberg ..... A63B 21/0087
2017/0209737 A1 * 7/2017 Tadi ..... A63B 71/0009
2017/0304678 A1 * 10/2017 Shade ..... A63B 23/1236
2017/0326407 A1 * 11/2017 Johnson ..... A63B 21/4045
2018/0043202 A1 * 2/2018 Johnson ..... A61H 3/04
2018/0111020 A1 * 4/2018 Lagree ..... A63B 22/203
2018/0193691 A1 * 7/2018 Lagree ..... A63B 23/0233
2018/0214738 A1 * 8/2018 Arias ..... A63B 23/04

* cited by examiner

SHOULDER REHABILITATION DEVICE

CROSS-REFERENCE TO RELATED APPLICATIONS

This application claims priority to, and is the National Stage of International Application No. PCT/US16/22330 filed on Mar. 14, 2016 and claims priority of U.S. Provisional Patent Application Ser. No. 62/133,303, filed on Mar. 14, 2015, the contents of which are incorporated by reference in their entirety.

STATEMENT REGARDING FEDERALLY SPONSORED RESEARCH OR DEVELOPMENT

None.

FIELD OF THE INVENTION

Certain embodiments described herein are related to the field of rehabilitation and physical therapy. More specifically, the present invention relates to shoulder rehabilitation devices.

BACKGROUND OF THE INVENTION

According to a Center of Disease Control report released in 2006, one out of ten adults surveyed experienced shoulder pain in the past thirty days. And according to the American Academy of Orthopaedic Surgeons, in 2006 almost 7.5 million visits were made to physicians for shoulder problems. Shoulder rehabilitation, strengthening, and flexibility exercises are very beneficial in the treatment of many common causes of shoulder pain and injuries. Shoulder rehabilitation focuses on flexibility and strength. One area of shoulder rehabilitation that is difficult to target and that many approaches and devices miss is the rehabilitation of the rotator cuff. The rotator cuff is the group of muscles and tendons that surround the shoulder joint. Injuries to the rotator cuff are the most common cause of shoulder pain. The rotator cuff muscles can be exercised with little or no weights.

There remains a need for a lightweight, configurable shoulder rehabilitation device for use in recovery from shoulder injuries, increases shoulder flexibility, and provides strengthening of the shoulder.

BRIEF SUMMARY OF THE INVENTION

Embodiments described herein are directed to a device and method of using the device for shoulder rehabilitation.

In one embodiment, the device is comprised of a base having at least one hand grip coupled to at least one guide rail, wherein the hand grip is configured to move along the guide rail to provide the desired movement of the hand and arm to provide a desired movement of the shoulder. The guide rail can be coupled to a platform or support collars that are attached to an adjustable bench or pole, respectively. The device can be configured using one or more joints to alter the positioning of the guide rails to provide for a variety of movements. The joint(s) provide for rotation around 1, 2, or 3 axis. In certain aspects the device can be configured to rotate around the x or z axis. In other aspects the height of the device can be adjusted by altering the height of supports or the height of the support collars. In certain aspects the guide rail can be shaped for a particular movement. In one aspect the guide rail can be in an oblong arc, a circular arc, or undulating. Movement of the shoulder using the device can be used for a variety of purposes such as warming up, stretching, strengthening, and/or recovery. In yet another embodiment, the handgrip, also referred to as a handle, can be replaced by other handgrips and the handgrip can be various weights to add varying degrees of resistance. In certain respects the handgrip is configured to accept and hold weights, to be connected to a resistance-providing device or a combination thereof.

Other embodiments of the invention are discussed throughout this application. Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

The use of the word "a" or "an" when used in conjunction with the term "comprising" in the claims and/or the specification may mean "one," but it is also consistent with the meaning of "one or more," "at least one," and "one or more than one."

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The following drawings form part of the present specification and are included to further demonstrate certain aspects of the present invention. The invention may be better understood by reference to one or more of these drawings in combination with the detailed description of the specification embodiments presented herein.

DETAILED DESCRIPTION OF THE INVENTION

Disclosed herein is a device for shoulder rehabilitation. Also described are methods for using the same. The shoulder rehabilitation device described herein is configurable for a variety of movements to exercise, stretch, and strengthen the shoulder. The device is also configurable to fit a variety of patients, from athletes to the wheelchair bound and from young to the elderly.

Figure 1A:
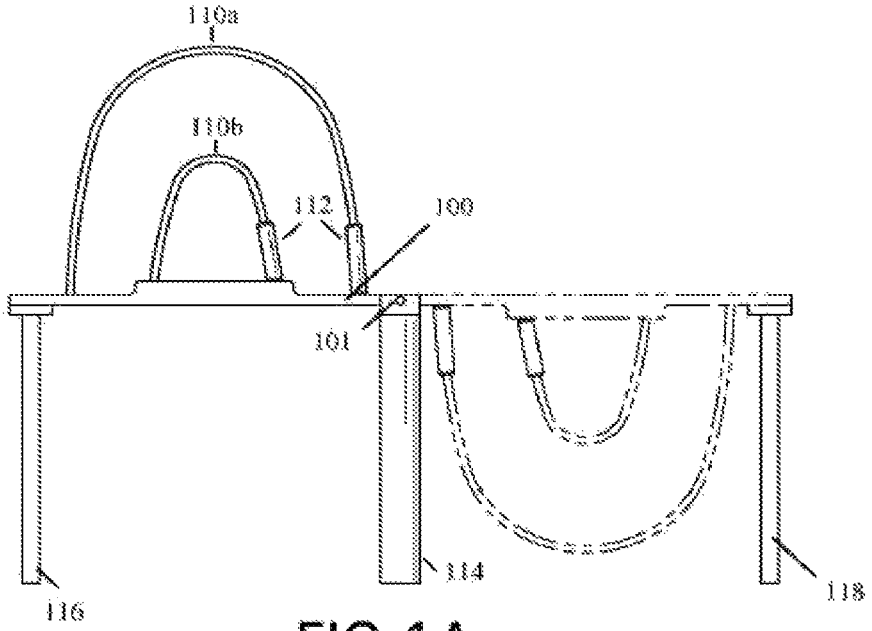
FIG. 1 illustrates a configurable shoulder rehabilitation device. (A) Illustrates an embodiment that is reconfigurable by rotation about the z axis or by flipping the device platform. (B) Illustrates an embodiment that can be rotated along the x axis or long axis of the platform. (C) Illustrates an overhead view that shows a padded support platform for supporting the elbow of the patient.

FIG. 1 illustrates one embodiment of a shoulder rehabilitation device. FIG. 1A shows platform 100 coupled to support leg 114 and optionally in contact with support legs 116 or 118. Platform 100 provides a stable, rigid base for guide rails 110*a* or 110*b*. In certain aspects a device will comprise guide rail 110*a* and a smaller more limited motion guide rail 110*b*. Some embodiments will comprise a single guide rail, represented by guide rail 110*a* or 110*b*. A guide rail can be shaped to guide a patient's hand along a predetermined path to achieve any number of motions. In certain aspects the guide rail is an arc to facilitate a rising rotating motion of the shoulder. In other aspects the guide rails can be in an oval arc, circular arc or undulating shape. Guide rails can be bent solid cylinders or tubes having a diameter of about 0.25, 0.5, 1.0, 1.25, 1.5, or 2.0 inches, including all values and ranges there between. In certain aspects the guide rail can be tapered or have a varying diameter to provide variable resistant. The guide rail can have a certain diameter at the ends of guide rail with the diameter gradually getting smaller as you progress to the midpoint. In other aspect the guide rails can have the smallest diameter at the guide rail ends with the diameter gradually increasing to a maximum at the midpoint of the rail. Other variations diameter are contemplated and can include a number of cycles larger to small diameter along the length of the guide rail. The guide rail ends can be positioned about 0.5, 1, 1.5, 2, 2.5, or 3 feet apart, including all values and ranges there between. The guide rail can be 1, 1.5, 2, 2.5, 3, or 3.5 feet in height, including all values and ranges there between. The guide rails can be maid of any suitable such as metal or polymer.

Figure 1B:
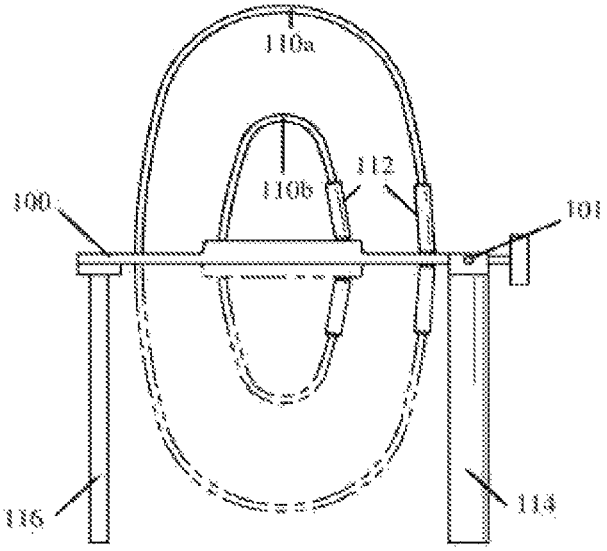
Figure 1C:
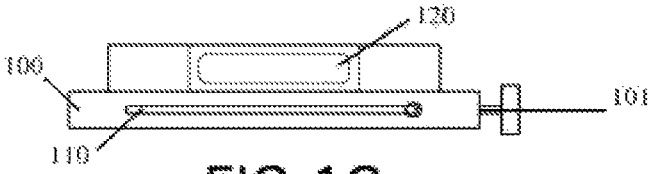
Figure 8A:
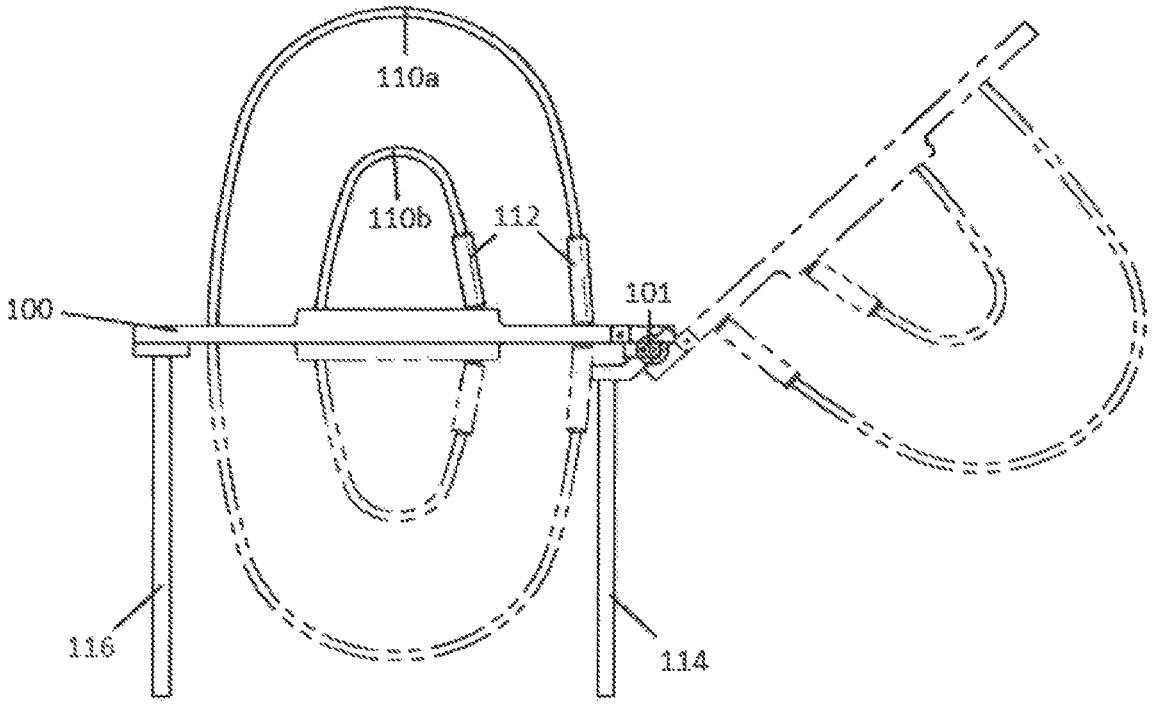
FIG. 8 illustrates an embodiment of the device that comprises a rotation/pivot joint.

In certain aspects supports 114, 116, and 118 can be height adjustable and capable of being locked in place, e.g., by a pin. Platform 100 can be coupled to support 114 by joint 101. Joint 101 can rotate about the z axis as a hinge, rotate about the x axis, or be configured to rotate about the z and x axis to provide for changing the orientation of guide rail 110*a* and/or 110*b*, e.g., from an upward position to a downward (flipping), which in turn alters guide rail 110 and the path and resulting shoulder motion of a patient moving hand grips 112 along guide rail 110. FIG. 8 illustrates a joint having multiple degrees of freedom and can rotate about the x and/or z axis. The embodiment of FIG. 1B depicts joint 101 that is configured to rotate platform 100 around a horizontal or x axis. The rotation can be to any degree and the platform locked at any point along the circumference of rotation. In certain aspects the device can be locked by a clamp or friction mechanism. The clamping or friction mechanism can be adjusted by tightening or loosening a screw mechanism. FIG. 1C is an illustration of an overhead view that shows an associated padded support 120 for resting a patient's elbow or other body part during while using the device.

Figure 2A:
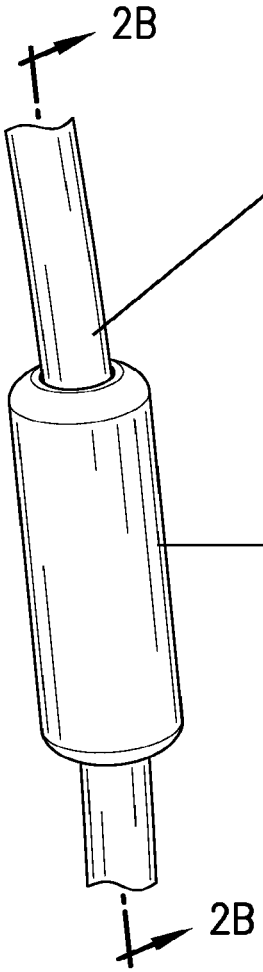
FIG. 2 illustrates one embodiment a slidable handle.
Figure 2B:
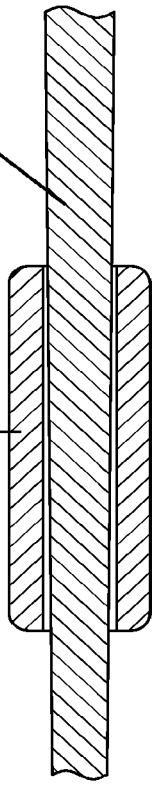
Figure 3A:
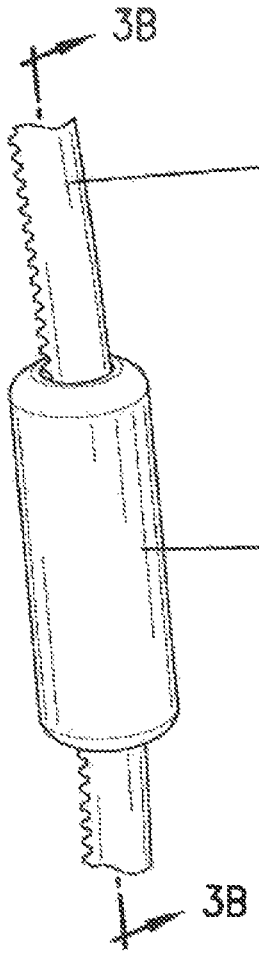
FIG. 3 illustrates a second embodiment of a slidable handle.
Figure 3B:
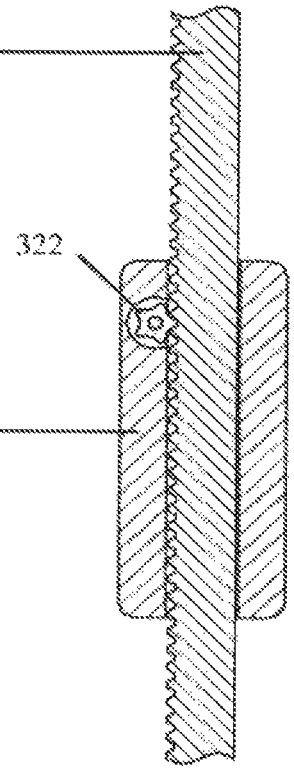
Figure 9A:
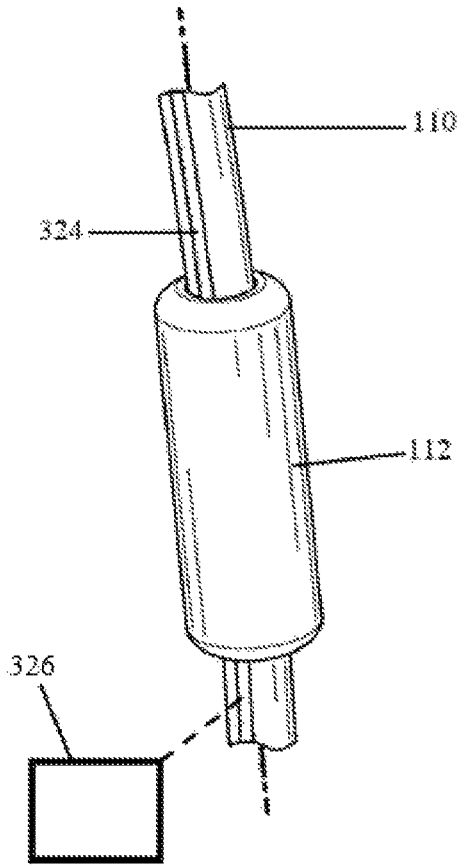
FIG. 9A illustrates a further embodiment of a slidable handle.

Hand grip 112 is designed to be grasped by a patient and to move along guide rail 110 (in certain aspects the hand grip forms a lumen in which the guide rail is positioned) under force applied by a patient (as depicted in FIG. 2 by a guide rail 210 and a passive hand grip 212) or in certain aspects a mechanical assist can be provided using a cable or gear attached to hand grip 112 (FIG. 3 shows one embodiment that can be used to provide resistance or assistance). In FIG. 3 the gear 322 can be coupled to a resistance mechanism or to a motor or crank to provide assistance during movement of hand grip 312. In a further aspect, as depicted in FIG. 9A, an assist cable 324 can be positioned along the long axis of guide rail 310 with one end attached to hand grip 312 and the other end attached to a pulling mechanism, e.g., an electric motor or a hand crank 326. In certain aspects a two-way assist can be provided by attaching a first cable to assist in a first direction and a second cable to assist in a second direction. FIG. 3 illustrates a geared hand grip that can also be passive or it can be coupled to a resistance mechanism that requires some force to move the hand grip along the guide rail. In other aspects resistance can be adjusted by adding weight to hand grip 112 or providing hand grips of different weight to be attached to the device. In certain aspects the resistance can be adjusted for the needs of particular patients.

Figure 4A:
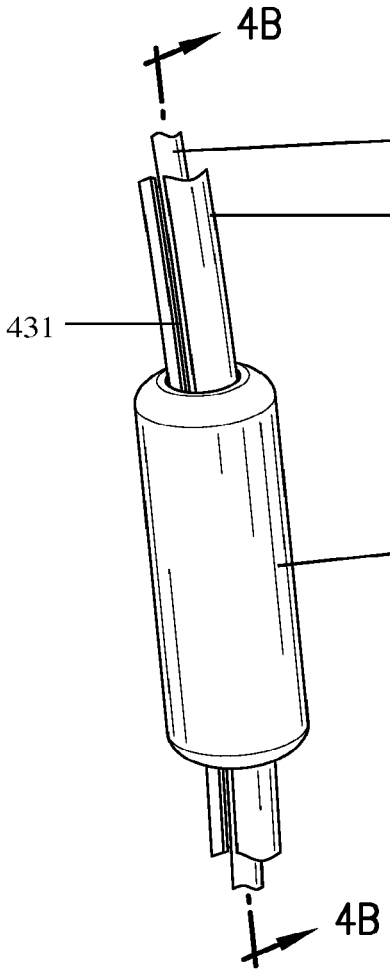
FIG. 4 illustrates a third embodiment of a slidable handle.
Figure 4B:
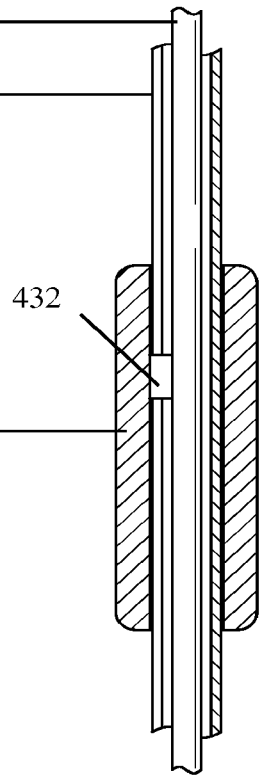

FIG. 4 illustrates another embodiment of the hand grip. FIG. 4 shows grip 412 having a friction sleeve 460 that can be adjusted by expanding or narrowing notch 431. When the notch is narrowed friction sleeve 460 provides greater resistance due to friction between friction sleeve 460 and guide rail 410. In certain aspects a notch 431 can be provided in friction sleeve 460. Notch 431 and receive tab 432, which guides handgrip 412.

Figure 5:
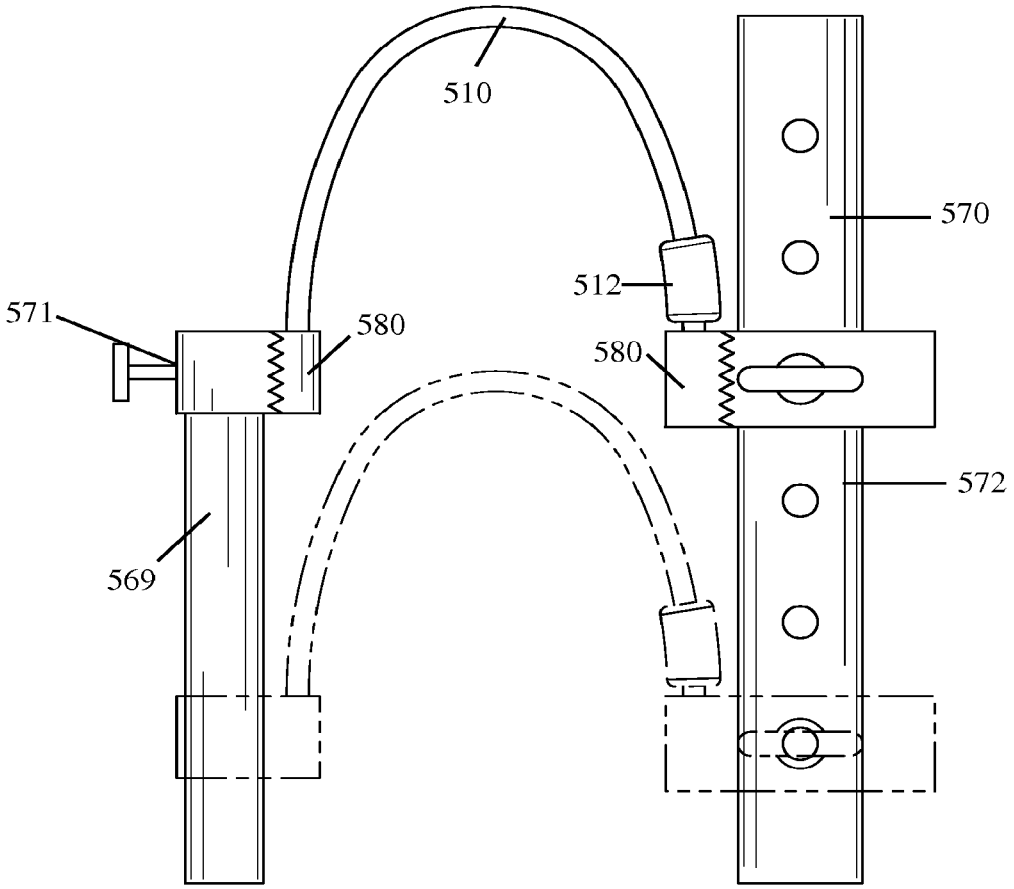
FIG. 5 illustrates one embodiment of an adjustable device that is coupled to a vertical pole support.
Figure 6:
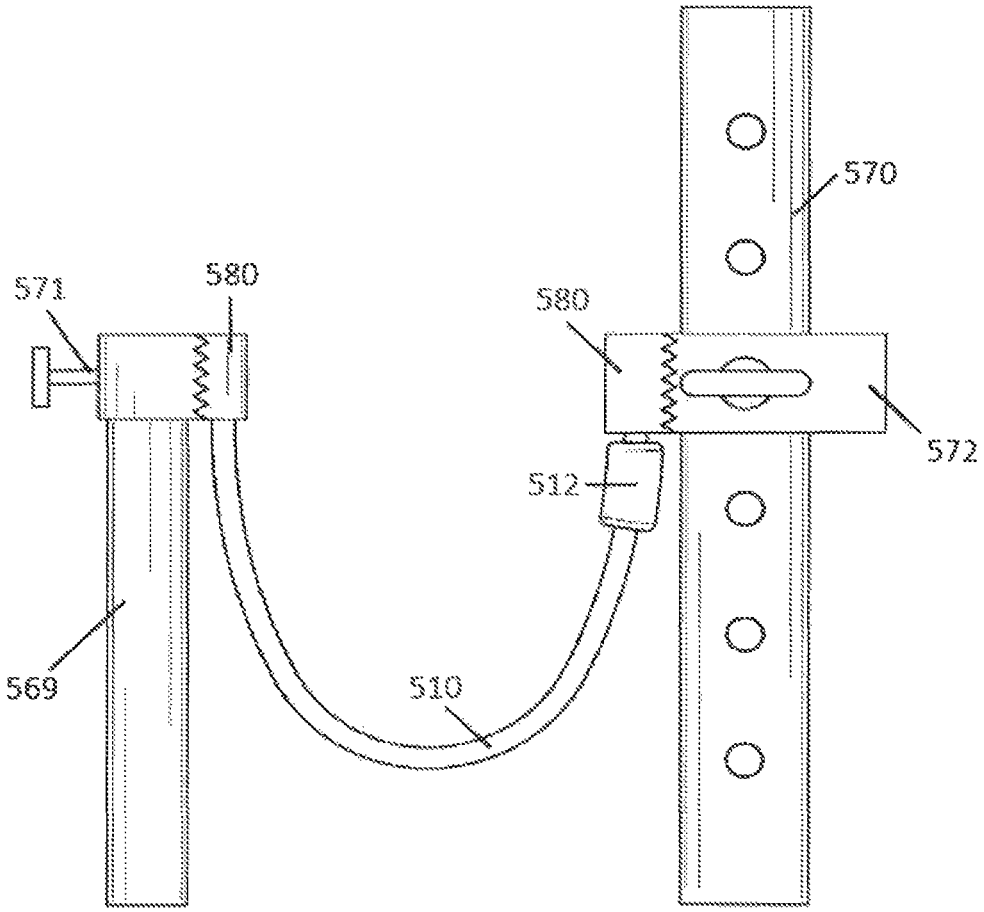
FIG. 6 illustrates an embodiment of an adjustable device that is coupled to a vertical pole support comprising a rotation axis perpendicular to the support pole.

FIG. 5 illustrates a pole-mounted embodiment of the device. The pole-mounted device comprises guide rails 569 and 570 coupled to support collars 571 and 572. Either one or both poles can be stably mounted. Stably mounted refers to securing the pole such that swaying and other movement is limited and allows one to use the device without unnecessary movement. In certain aspects the support collars can comprise rotatable attachments 580 for guide rail 510. Rotatable attachments 580 allow the guide rail to be rotated around the horizontal axis between support collars 571 and 572. The rotatable attachments can lock in position, thus the guide rail can be positioned at any point along the circumferential rotation or at any particular height. FIG. 6 shows device of FIG. 5 with guide rail in an inverted position.

Figure 7A:
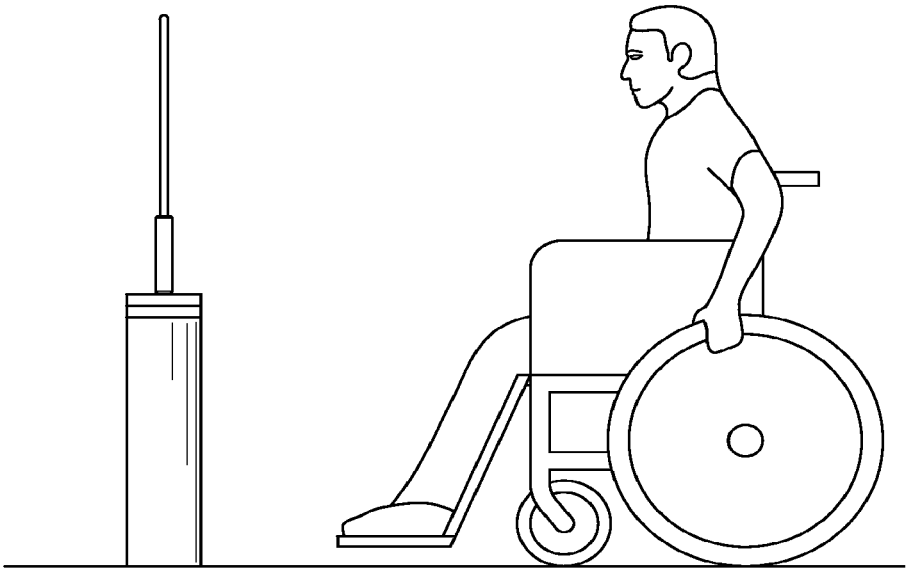
FIG. 7A-7B illustrates a wheelchair accessible configuration of the device.
Figure 7B:
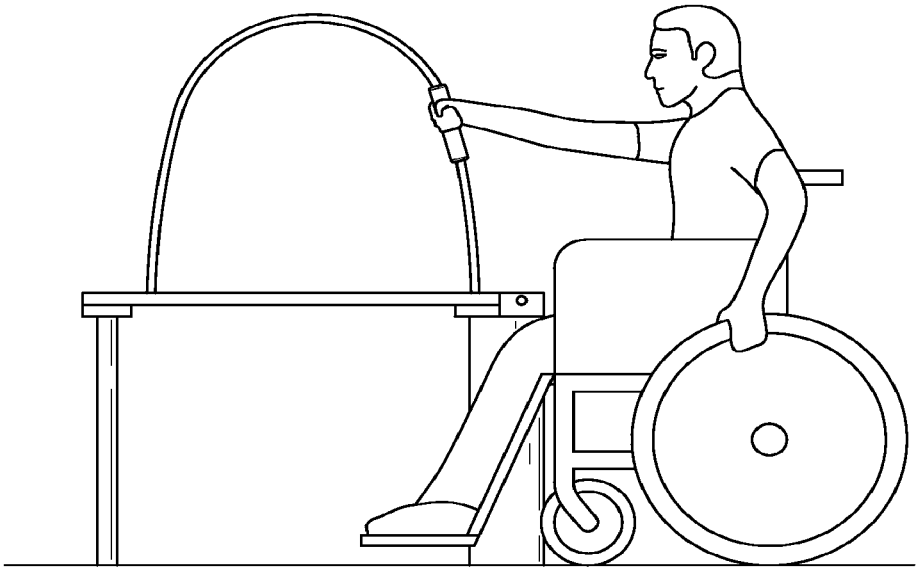

One benefit of such a device is that the device can be configured to target the rotator cuff. Most other devices only target the posterior and interior portion of the shoulder while this device targets those areas as well as the rotator cuff. Furthermore, the current device can be configured a number of ways specifically target various motions or accommodate all types of people. FIG. 7 illustrates a configuration for a wheelchair bound individual. The devices described herein use guided motion to target particular joints, muscles, and tendons. Such devices can be used as a warm up to help prevent shoulder injuries, to strength train and rehabilitate the shoulder, and to increase the flexibility of the shoulder.

The disclosed device and method of use is generally described, with examples incorporated as particular embodiments of the invention and to demonstrate the practice and advantages thereof It is understood that the examples are given by way of illustration and are not intended to limit the specification or the claims in any manner.

The invention claimed is:

1. A shoulder rehabilitation device comprising:

a platform having a first end and a second end, and a top face and a bottom face;

a guide rail having a first guide rail end and a second guide rail end, the first guide rail end coupled to a first portion of the platform and the second guide rail end coupled to a second portion of the platform;

a handgrip coupled to the guide rail and moveable back and forth along a length of the guide rail;

two or more supports coupled to the platform for elevating the platform; and at least one rotatable joint coupling the platform to one of the two or more supports in a manner to provide for relative movement between the platform and the respective support so as to enable a variable positioning of the platform and guide rail between a first position in which the guide rail is oriented in a first direction and a second position in which the guide rail is oriented in a second direction, the at least one joint being configured to enable selective fixing of the platform in the first and second positions.

2. The device of claim 1, wherein the handgrip is configured to provide resistance to movement of the handgrip along the guide rail.

3. The device of claim 1, wherein the handgrip is attached to an assist device configured to aid in movement of the handgrip along the guide rail.

4. The device of claim 3, wherein the assist device comprises a cable extending along the guide rail and a crank for pulling the handgrip by the cable.

5. The device of claim 3, wherein the assist device comprises a gear attached to the hand grip.

6. The device of claim 1, wherein the handgrip is configured to be of adjustable weight.

7. The device of claim 6, wherein the handgrip is configured to be of adjustable weight by enabling the acceptance and holding of weights on the handgrip.

8. The device of claim 1, wherein the at least one rotatable joint is configured to rotate the platform about a horizontal axis of the platform.

9. The device of claim 1, wherein the shoulder rehabilitation device further comprises a second guide rail having a first guide rail end coupled to a third portion of the platform and a second guide rail end coupled to a fourth portion of the platform.

10. The device of claim 1, wherein the shoulder rehabilitation device is comprises three or more guide rails, each guide rail having a first guide rail end coupled to a respective first portion of the platform and a second guide rail end coupled to a respective second portion of the platform.

11. The device of claim 1, wherein the guide rail forms an arc.

12. The device of claim 9, wherein the second guide rail forms an arc.

13. The device of claim 10, wherein at least one guide rail forms an arc.

14. The device of claim 10, wherein at least two guide rails each form an arc.

15. The device of claim 1, wherein the shoulder rehabilitation device is configured to enable adjustment to a height of the platform.

16. The device of claim 1, further comprising a friction sleeve between the handgrip and the guide rail.

17. A shoulder rehabilitation device comprising:

a platform having a first end and a second end, and a top face and a bottom face;

a guide rail having a first guide rail end and a second guide rail end, the first guide rail end coupled to a first portion of the platform and the second guide rail end coupled to a second portion of the platform;

a handgrip coupled to the guide rail and moveable back and forth along a length of the guide rail; and an assist device attached to the handgrip and configured to aid in movement of the handgrip along the guide rail, the assist device comprising a cable extending along the guide rail and a crank for pulling the handgrip by the cable.

18. A shoulder rehabilitation device comprising:

a platform having a first end and a second end, and a top face and a bottom face;

a guide rail having a first guide rail end and a second guide rail end, the first guide rail end coupled to a first portion of the platform and the second guide rail end coupled to a second portion of the platform;

a handgrip coupled to the guide rail and moveable back and forth along a length of the guide rail; and a friction sleeve between the handgrip and the guide rail, the friction sleeve being adapted to enable adjustment of a friction resistance to movement of the handgrip along the guide rail.

19. The device of claim 18, wherein the friction sleeve comprises a notch extending along an axial length of the friction sleeve, the notch having an adjustable width whereby expanding the width of the notch reduces the friction resistance and narrowing the width of the notch increases the friction resistance.

20. The device of claim 19, wherein the handgrip comprises a tab adapted for reception in the notch of the friction sleeve for guiding the handgrip as it is moved along the guide rail.

* * * * *